US005212034A

United States Patent [19]

Tsuyama et al.

[11] Patent Number: 5,212,034

[45] Date of Patent: May 18, 1993

[54] ELECTROPHOTOGRAPHIC DEVELOPMENT MAGNETIC RESIN COATED CARRIER

[75] Inventors: Koichi Tsuyama, Kobe; Hiroshi Harada, Nikaho, both of Japan

[73] Assignees: Mita Industrial Co., Ltd., Osaka; TDK Corporation, Tokyo, both of Japan

[21] Appl. No.: 711,143

[22] Filed: Jun. 6, 1991

[30] Foreign Application Priority Data

Jun. 6, 1990 [JP] Japan ..... 2-148357

[51] Int. Cl.[5] ..... G03G 9/113

[52] U.S. Cl. ..... 430/108; 430/106.6; 430/904

[58] Field of Search ..... 430/106.6, 108, 904, 430/106

[56] References Cited

U.S. PATENT DOCUMENTS 4,042,517 8/1977 Morconi et al. ..... 252/62.1 P
4,912,005 3/1990 Goodman et al. ..... 430/108
5,049,470 9/1991 Higashiguchi et al. ..... 430/122

FOREIGN PATENT DOCUMENTS 2075209 11/1981 United Kingdom .

OTHER PUBLICATIONS

Patent Abstracts of Japan, vol. 8, No. 204, p. 301[1641] Sep. 18, 1984; & JP-A-59 088 742 (Konishiroku Shashin Kogyo K.K.) 22-05-84 Abstract only.
Patent Abstracts of Japan, vol. 9, No. 323, p. 414, [2046], Dec. 18, 1985; & JP-A-60 150 057 (Fuji Xerox K.K.) 07-08-1985 Abstract.
Patent Abstracts of Japan, vol. 10, No. 152 p. 462, [2208], Jun. 3, 1986; & JP-A-61 006 660 (Konishiroku Shashin Kogyo K.K.) 13-01-1982 Abstract.
Patent Abstracts of Japan, vol. 12, No. 114, p. 688 [2961], Apr. 12, 1988 & JP-A-62 242 961 (Hitachi Metals Ltd) 23-10-1987 Abstract.
Patent Abstracts of Japan, vol. 14, No. 54, p. 999, [3997], Jan. 31, 1990; & JP-A-1 281 460 (Fuji Xerox Ltd) 13-11-1989 Abstract.

*Primary Examiner*—Marion E. McCamish
*Assistant Examiner*—Rosemary Ashton
*Attorney, Agent, or Firm*—Oblon, Spivak, McClelland, Maier & Neustadt

[57] ABSTRACT

Magnetic carrier for use in electrophotographic development takes the form of ferrite core particles each having a resinous coating. Ferrite core particles having a limited particle size distribution are coated with a resinous composition based on a copolymer consisting essentially of ethyl methacrylate, 15 to 25% by weight of styrene, up to 2% by weight of dodecyl methacrylate, and up to 2% by weight of 2-hydroxyethyl acrylate. The magnetic carrier particles have a resistance of $8.5\times10^7$ to $2.2\times10^9\ \Omega$. This carrier has a sharp distribution of electric charge and a quick rise of charging performance. The coating is tough enough to impart durability to the carrier.

5 Claims, 2 Drawing Sheets

ELECTROPHOTOGRAPHIC DEVELOPMENT MAGNETIC RESIN COATED CARRIER

This invention relates to magnetic carrier particles for use in electrophotographic development, and more particularly, to resin coated magnetic carrier particles for use in magnetic brush development.

BACKGROUND OF THE INVENTION

Typical magnetic carrier for use in electrophotographic magnetic brush development along with toner is iron powder and ferrite particles having a resinous coating. The magnetic carrier is effective in triboelectrically charging the toner whereby the toner adheres to the carrier by an electrostatic force and then transferred to a photoconductor upon development.

Therefore, the magnetic carrier particles are required to have a sufficient triboelectric charge in a uniform manner to pick up the toner uniformly for subsequent deposition. The carrier particles should also be efficient in carrying the toner in the developing unit and be free flowing powder.

Further, the carrier particles function as one electrode in the developing zone for producing a uniform electric field. They are thus required to have a desired resistance for a particular type of copying machine within the range of from $10^5$ to $10^{12}$ Ω by changing the composition of magnetic particles on which a resinous coating is applied or changing the composition of the resinous coating on magnetic particles. It is desired that the electric resistance of the carrier particles do not lower under humid conditions.

Another requirement imposed on the carrier is durability in that the carrier can maintain and perform its function consistently in the developing unit.

However, the prior art resin coated carriers have several problems including a broad distribution of electric charge, low coating strength, a slow rise of triboelectric charging upon replenishment of toner, a change of electric charge with time, and the fusion of toner to carrier (known as toner spent). As a result, images become poor in quality aspects such as image reproduction and resolution. As copying operation is continued over several ten thousand sheets, many quality factors including image density, fog, reproduction and resolution will lower with time and carrier adhesion and toner scattering occur.

SUMMARY OF THE INVENTION

A primary object of the present invention is to provide magnetic carrier particles for use in electrophotographic development which are improved in charging performance and coating strength, durable, and stable while helping produce images of quality.

The present invention provides magnetic carrier particles for use in electrophotographic development, each in the form of a ferrite core particle having a resinous coating on the surface thereof. The ferrite core particles have a saturation magnetization of 45 to 55 emu/g and at least 90% by weight of the particles have a particle size of 74 to 149 μm. The resinous coating has a copolymer composition comprising a major proportion of a copolymer of ethyl methacrylate and styrene having a styrene content of from 15 to 25% by weight of the copolymer, up to 2% by weight of dodecyl methacrylate, and up to 2% by weight of 2-hydroxyethyl acrylate. The magnetic carrier particles have a resistance of $8.5\times10^7$ to $220\times10^7$ Ω.

According to the present invention, there are obtained improved magnetic carrier particles for use in electrophotographic development by restricting (1) the saturation magnetization and particle size distribution of ferrite cores to specific ranges, (2) the composition of the resinous coating to an ethyl methacrylate/styrene copolymer having a specific styrene content with specific additional monomers, and (3) the resistance of the carrier particles to a specific range. The carrier particles shows improved charging performance and their coating is tough so that the carrier particles remain durable and stable during continuous or repetitive electrophotographic development operation while helping produce images of quality.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
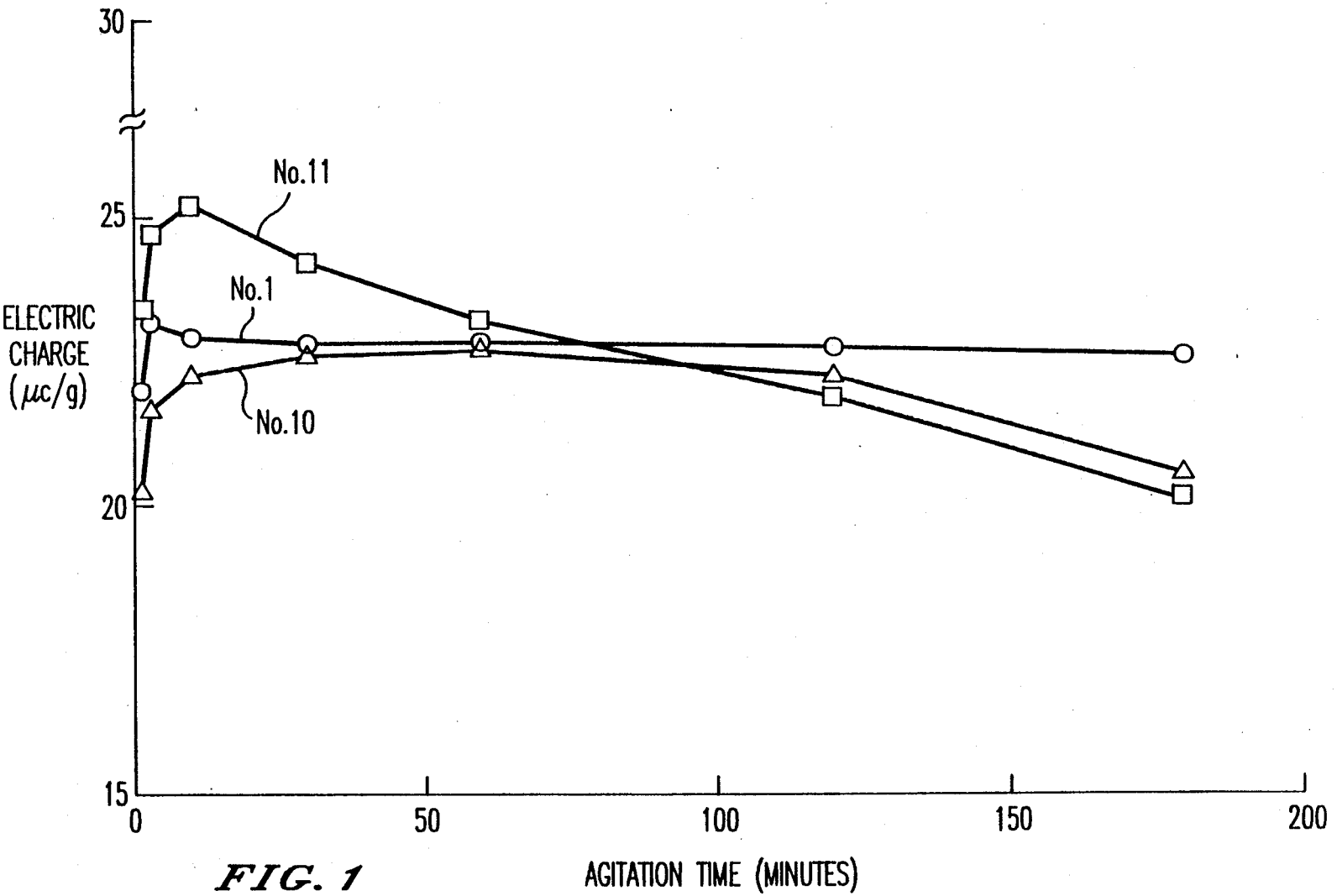
FIG. 1 is a graph showing the electric charge quantity of some developers changing with agitation time.

The magnetic carrier particles for use in electrophotographic development according to the present invention are in the form of magnetic core particles having a resinous coating on the surface thereof.

The resinous coating is formed of a copolymer composition comprising a major proportion of acrylic and styrene monomers wherein the acrylic monomer is ethyl methacrylate. Use of other acrylic monomers is less desirable in rise of electric charging and change of electric charge with time. Ethyl methacrylate forms a copolymer with unsubstituted styrene. The copolymer should have a styrene content of 15 to 25% by weight of the copolymer. Outside this range, the resulting carrier particles are less desirable in rise of electric charging and change of electric charge with time.

The copolymer contains as a third monomer up to 2% by weight, particularly 0.1 to 2% by weight of dodecyl methacrylate. Inclusion of dodecyl methacrylate improves the compatibility of the copolymer with a resistance modifier such as carbon black, reduces resistance variation, improves environmental dependency.

The copolymer contains as a fourth monomer up to 2% by weight, particularly 0.1 to 2% by weight of 2-hydroxyethyl acrylate. Inclusion of 2-hydroxyethyl acrylate improves the adhesion of the copolymer to ferrite cores and enhances the strength and dynamic durability of the coating.

The copolymer may be prepared from the monomers, ethyl methacrylate, styrene, dodecyl methacrylate, and 2-hydroxyethyl acrylate by conventional polymerization techniques such as solution polymerization.

It will be understood that the copolymer may contain a minor proportion of another ethylenic monomer or monomers in addition to the above-mentioned monomers. Such ethylenic monomers are acrylic monomers (other than the above-mentioned ones) and cyan monomers. Optional monomers are used in an amount of less than 2% by weight of the copolymer insofar as they do not alter the moisture resistance and durability of the resinous coating.

Often, the copolymer has a glass transition temperature Tg of up to 130° C., especially from 40° to 130° C.

The copolymer composition of which the coating is formed may further contain a resistance control agent, for example, 0.5 to 5% by weight of carbon black and a charge control agent, for example, 0.5 to 3% by weight of a metal complex.

The magnetic core particles are provided by a powder of ferrite having a spinel structure. Included in the spinel ferrite are soft ferrites such as 2-3 spinel and 1-3 spinel, and magnetite ($Fe_3O_4$). The soft ferrites may contain at least one member selected from Ni, Mn, Mg, Zn, Cu, and Co. These magnetic core particles may be prepared by conventional well-known techniques.

The ferrite core particles should have a particle size distribution that those particles having a particle size of 74 to 149 μm occupy at least 90% by weight of the ferrite core particles. Carrier adhesion (adhesion of the carrier to non-image-bearing areas) will occur particularly with a higher content of smaller particles of less than 74 μm. The ferrite core particles should have a saturation magnetization of 45 to 55 emu/g. Carrier adhesion will occur with lower magnetization whereas the reproduction of fine lines becomes poor with higher magnetization.

It is to be noted that the magnetic particles may be primed with various coupling agents prior to application of the resinous composition. Alternatively, a coupling agent is added to the resinous composition.

A resinous coating is formed on the surface of magnetic particles by forming a fluidized or tumbling layer of the particles in a drum, applying a resin solution through a spray nozzle to coat the particles therewith while heating, and optionally drying the coated particles. Usually, the coating temperature ranges from 40° to 80° C. and the drying temperature ranges from 40° to 80° C.

The magnetic particles which are coated with the resinous composition using a nozzle sprayer or the like and optionally dried are then heat treated. The heat treatment is at a temperature above the Tg of the synthetic resin (copolymer), preferably from about 100° to about 300° C. for about 5 to about 90 minutes.

Using the copolymer emulsion, magnetic particles are covered with a coating, preferably a continuous coating of the copolymer which has a radial thickness of 0.1 to 5 μm, more preferably 0.5 to 3 μm.

The magnetic carrier in the form of coated magnetic particles according to the present invention generally has an electric charge quantity of 5 to 45 μC/g (C: coulomb). The carrier has a fluidity of 25 to 35 sec./50 g as measured by weighing 50 grams of the carrier, charging a powder fluidity meter with it, and determining the falling rate.

The carrier should have a saturation magnetization of 45 to 55 emu/g. Also it should have an electric resistance of $8.5\times10^7$ to $2.2\times10^9$ Ω as measured with an applied voltage of 1000 volts. Fine line image reproduction becomes poor with a lower resistance whereas solid image reproduction becomes poor and carrier adhesion occurs with a higher resistance.

Figure 2:
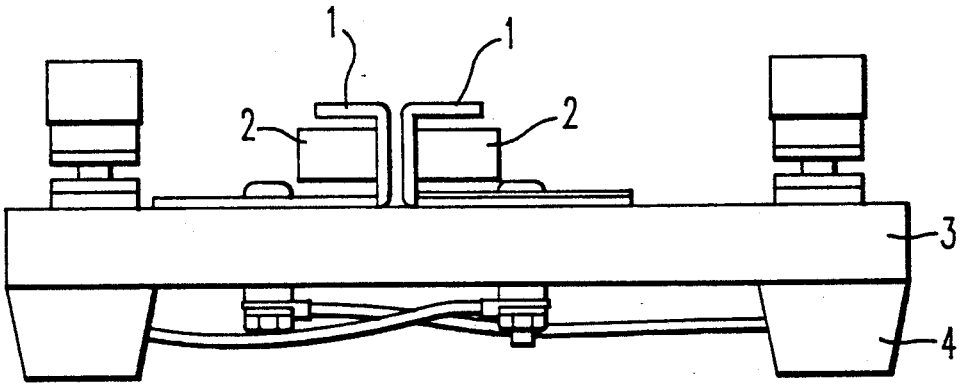
FIGS. 2 and 3 are side and plan views of a resistance measuring device, respectively.
Figure 3:
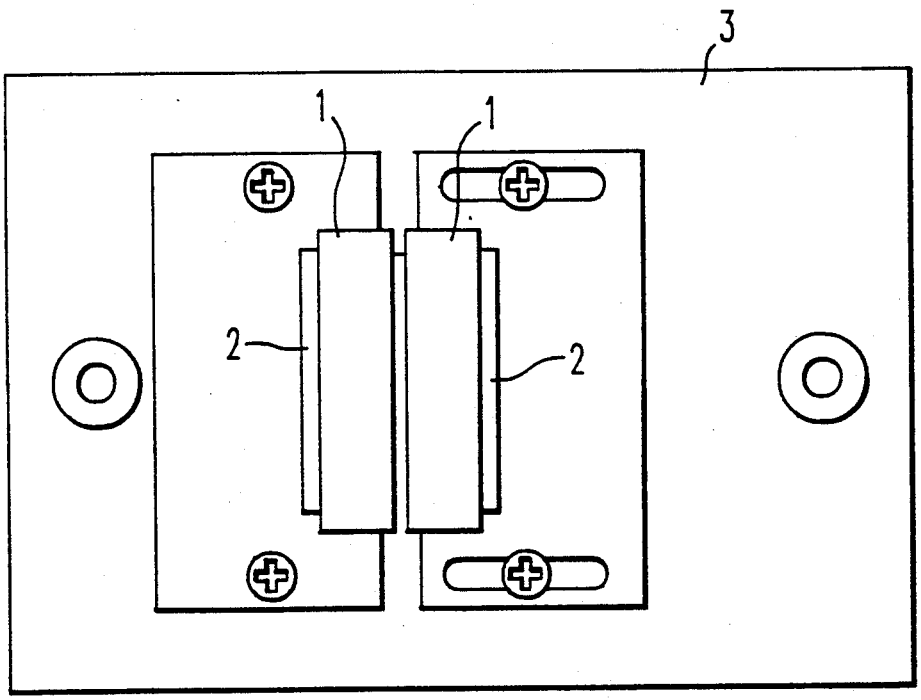

The electric resistance is measured by using a resistance tester simulating the magnetic brush development system. The tester is shown in FIGS. 2 and 3 as comprising a pair or magnets 2 and 2 resting on an insulating platform 3 with legs 4 of insulating rubber. The N and S poles of the magnets 2 and 2 are opposed at a spacing of 5 mm. Each magnetic pole has a surface magnetic flux density of 1,500 Gauss and an opposed surface area of 10×30 mm. Disposed between the magnetic poles are parallel plate electrodes 1 and 1 which are spaced 2 mm from each other. A sample (200 mg) is introduced between the electrodes and magnetically held thereat. Then the resistance of the sample is measured by means of an insulation resistance meter, Toa Super Megohmmeter Model SM-5E manufactured by Toa Electromagnetic Industry K.K.

The carrier of the present invention is combined with a toner to form a developer which is ready for use in electrophotographic development. The type and amount of the toner which can be combined with the present carrier are not particularly limited. Also, no particular limitation is imposed on the magnetic brush development technique and the type of photoconductor which are used in development to produce electrostatic duplicate images.

EXAMPLE

Examples of the present invention are given below by way of illustration and not by way of limitation.

EXAMPLE 1

The magnetic core particles used were Mg-Cu-Zn ferrite particles having a particle size distribution and saturation magnetization as shown in Table 1. A fluidized bed of the ferrite particles was formed in a drum of a tumbling/fluidizing coating apparatus and preheated at 50° C.

Various copolymer compositions as shown in Table 1 were sprayed at 50° C. over the fluidized bed to coat the particles with the resin. The coated particles were then heat treated for one hour.

Table 1 reports the main monomers of the copolymer (in part by weight), the amounts of ethylenic monomers (in % by weight), and resistance (Ω) of the coated particles.

The resistance was adjusted by adding carbon black to the copolymer solution.

It was found that the ferrite particles had a uniform continuous coating of 0.6 to 1.2 μm thick.

TABLE 1

| | Core particle | | | Coating | | | | |
|---|---|---|---|---|---|---|---|---|
| | Saturation | Particle size | | | | | | |
| Carrier No. | magnetization (emu/g) | 74~149 μm (wt %) | <74 μm (wt %) | Main monomers (part by weight) | | Dodecyl methacrylate (wt %) | 2-hydroxyethyl acrylate (wt %) | Resistance (Ω) |
| 1 | 50 | 95 | 5 | Ethyl methacrylate | (80) | 2 | 2 | $7.6\times10^8$ |
| | | | | Styrene | (20) | | | |
| 2 | 50 | 95 | 5 | Ethyl methacrylate | (80) | 0.5 | 0.5 | $2.5\times10^8$ |
| | | | | Styrene | (20) | | | |
| 3 Comparison | 50 | 95 | 5 | Ethyl methacrylate | (80) | 2 | 0 | $1.1\times10^9$ |
| | | | | Styrene | (20) | | | |
| 4 Comparison | 50 | 95 | 5 | Ethyl methacrylate | (80) | 0 | 2 | $5.8\times10^8$ |

TABLE 1-continued

| Carrier No. | Core particle: Saturation magnetization (emu/g) | Core particle: Particle size 74~149 μm (wt %) | Core particle: Particle size <74 μm (wt %) | Coating: Main monomers (part by weight) | Coating: Dodecyl methacrylate (wt %) | Coating: 2-hydroxyethyl acrylate (wt %) | Resistance (Ω) |
|---|---|---|---|---|---|---|---|
| 5 Comparison | 50 | 95 | 5 | Styrene (20) Ethyl methacrylate (80) | 0 | 0 | $9.5 \times 10^8$ |
| 6 | 45 | 95 | 5 | Styrene (20) Ethyl methacrylate (80) | 2 | 2 | $5.8 \times 10^8$ |
| 7 Comparison | 60 | 95 | 5 | Styrene (20) Ethyl methacrylate (80) | 2 | 2 | $9.5 \times 10^8$ |
| 8 Comparison | 40 | 95 | 5 | Styrene (20) Ethyl methacrylate (80) | 2 | 2 | $4.1 \times 10^8$ |
| 9 Comparison | 50 | 80 | 20 | Styrene (20) Ethyl methacrylate (80) | 2 | 2 | $7.6 \times 10^8$ |
| 10 Comparison | 50 | 95 | 5 | Styrene (20) Ethyl methacrylate (100) | 2 | 2 | $5.8 \times 10^8$ |
| 11 Comparison | 50 | 95 | 5 | Ethyl methacrylate (50) Styrene (50) | 2 | 2 | $1.1 \times 10^9$ |
| 12 Comparison | 50 | 95 | 5 | Ethyl methacrylate (80) Styrene (20) | 2 | 2 | $7.0 \times 10^7$ |
| 13 Comparison | 50 | 95 | 5 | Ethyl methacrylate (80) Styrene (20) | 2 | 2 | $4.0 \times 10^9$ |

A toner was prepared from the following ingredients.

| Ingredient | Parts by weight |
|---|---|
| Styrene-acryl resin | 100 |
| Low molecular weight polypropylene | 4 |
| Charge control agent (metal-containing azo dye) | 1.5 |
| Carbon black | 10 |

The ingredients were mixed in a Henschel mixer, melted and milled in a milling mixer, cooled, and crushed. Using a classifier, there were obtained particles having a particle size of 5 to 20 μm. The toner was obtained by adding 0.3% by weight of silica to the particles and mixing them in a V blender.

A developer was prepared by adding 35 parts by weight of the toner to 965 parts by weight of the carrier and agitating the mixture at 75 r.p.m. for two hours.

Using the developer, electrostatic images were developed in a modified version of copying machine DC-3255 manufactured by Mita Industrial Co., Ltd. The concentration of the toner was monitored by means of a toner sensor. The toner replenisher system was controlled such that 0.5% by weight of a fresh toner was replenished when the toner concentration dropped to 3.0% by weight. The copying machine was continuously operated at 20° C. and RH 60% to duplicate 150,000 test chart copies.

Table 2 shows the image density and fog at the end of the 1st and repeated copying. Table 2 also shows reproduction, resolution, adhesion of carrier to non-image areas, and toner scattering at the end of the 1st and repeated copying.

Further reported in Table 2 is electric charge. The electric charge was measured by taking a sample from the developer at the end of copying, and measuring the electrostatic charge quantity of the sample by means of a blow-off charge tester (manufactured by Toshiba Chemical K.K.) after agitation for 10 seconds.

FIG. 1 shows the rise of charging process for carrier Nos. 1, 10 and 11 by plotting the electric charge quantity as a function of agitating time.

Separately, the copying machine was continuously operated under different sets of conditions: 10° C. and RH 20% and 30° C. and RH 80% to duplicate 20,000 copies for each set.

Table 3 shows the charge quantity, image density, fog, reproduction, resolution, carrier adhesion, and toner scattering at the end of the 20,000th copying.

In Tables 2 and 3, reproduction, carrier adhesion, and toner scattering were visually observed and evaluated in three ratings of "O" for passed, "Δ" for fair, and "X" for rejected.

TABLE 2

| Carrier No. | Initial Quality: Charge | Image density | Fog | Reproduction: Line image | Half tone image | Solid image | Resolution | Carrier adhesion | Final Quality: Copies | Charge | Image density | Fog |
|---|---|---|---|---|---|---|---|---|---|---|---|---|
| 1 | 22.5 | 1.36 | 0.002 | ○ | ○ | ○ | 5.6 | ○ | 150000 | 21.8 | 1.37 | 0.002 |
| 2 | 23.0 | 1.36 | 0.002 | ○ | ○ | ○ | 5.6 | ○ | 150000 | 22.1 | 1.37 | 0.002 |
| 3* | 22.0 | 1.35 | 0.002 | ○ | ○ | ○ | 5.6 | ○ | 100000 | 20.5 | 1.38 | 0.008 |
| 4* | 22.8 | 1.35 | 0.003 | ○ | ○ | ○ | 5.6 | ○ | 100000 | 20.2 | 1.37 | 0.004 |
| 5* | 22.3 | 1.36 | 0.003 | ○ | ○ | ○ | 5.6 | ○ | 100000 | 20.6 | 1.39 | 0.010 |
| 6 | 21.8 | 1.36 | 0.003 | ○ | ○ | ○ | 5.6 | ○ | 150000 | 21.0 | 1.37 | 0.003 |
| 7* | 21.9 | 1.33 | 0.003 | Δ | ○ | ○ | 5.0 | ○ | 150000 | 20.8 | 1.36 | 0.004 |
| 8* | 21.5 | 1.35 | 0.003 | ○ | ○ | ○ | 5.6 | ○ | 150000 | 21.0 | 1.37 | 0.004 |
| 9* | 22.3 | 1.36 | 0.002 | ○ | ○ | ○ | 5.6 | ○ | 150000 | 21.4 | 1.37 | 0.003 |
| 10* | 21.0 | 1.37 | 0.003 | Δ | ○ | ○ | 5.6 | ○ | 100000 | 19.0 | 1.39 | 0.005 |
| 11* | 23.0 | 1.35 | 0.003 | Δ | ○ | ○ | 5.6 | ○ | 100000 | 19.5 | 1.39 | 0.005 |
| 12* | 21.8 | 1.37 | 0.003 | Δ | ○ | ○ | 5.0 | ○ | 150000 | 21.1 | 1.38 | 0.003 |
| 13* | 23.3 | 1.34 | 0.003 | ○ | ○ | Δ | 5.6 | ○ | 150000 | 22.0 | 1.36 | 0.004 |

Final Quality

Reproduction

TABLE 2-continued

| Carrier No. | Line image | Half tone image | Solid image | Resolution | Carrier adhesion | Toner scattering |
|---|---|---|---|---|---|---|
| 1 | ○ | ○ | ○ | 5.0 | ○ | ○ |
| 2 | ○ | ○ | ○ | 5.0 | ○ | ○ |
| 3* | Δ | ○ | ○ | 4.5 | ○ | Δ |
| 4* | Δ | ○ | ○ | 4.5 | Δ | ○ |
| 5* | Δ | Δ | ○ | 4.5 | Δ | Δ |
| 6 | ○ | ○ | ○ | 5.0 | ○ | ○ |
| 7* | X | ○ | ○ | 4.0 | ○ | ○ |
| 8* | ○ | ○ | ○ | 5.0 | X | ○ |
| 9* | ○ | ○ | ○ | 5.0 | X | ○ |
| 10* | Δ | Δ | ○ | 4.5 | ○ | Δ |
| 11* | Δ | Δ | ○ | 4.5 | ○ | Δ |
| 12* | Δ | ○ | ○ | 4.0 | ○ | ○ |
| 13* | ○ | ○ | Δ | 4.5 | Δ | ○ |

*Comparison

TABLE 3

| | Low temperature/low humidity environment (10° C./20% RH) | | | | | | | | | High temperature/ high humidity environment (30° C./80% RH) | | |
|---|---|---|---|---|---|---|---|---|---|---|---|---|
| | | | | Reproduction | | | | | Toner | | | |
| Carrier No. | Charge | Image density | Fog | Line image | Half tone image | Solid image | Resolution | Carrier adhesion | Scat-tering | Charge | Image density | Fog |
| 1 | 23.0 | 1.36 | 0.003 | ○ | ○ | ○ | 5.6 | ○ | ○ | 22.0 | 1.38 | 0.001 |
| 2 | 23.2 | 1.36 | 0.003 | ○ | ○ | ○ | 5.6 | ○ | ○ | 22.8 | 1.37 | 0.001 |
| 3* | 24.0 | 1.34 | 0.005 | Δ | ○ | Δ | 4.5 | ○ | Δ | 19.3 | 1.40 | 0.005 |
| 4* | 26.0 | 1.33 | 0.005 | Δ | ○ | ○ | 4.5 | Δ | ○ | 18.6 | 1.39 | 0.006 |
| 5* | 26.7 | 1.30 | 0.006 | Δ | Δ | Δ | 4.0 | Δ | Δ | 17.4 | 1.41 | 0.007 |
| 6 | 23.1 | 1.35 | 0.003 | ○ | ○ | ○ | 5.6 | ○ | ○ | 21.5 | 1.37 | 0.002 |
| 7* | 22.4 | 1.36 | 0.003 | Δ | ○ | ○ | 4.5 | ○ | ○ | 21.6 | 1.38 | 0.001 |
| 8* | 22.6 | 1.35 | 0.002 | ○ | ○ | ○ | 5.6 | Δ | ○ | 21.3 | 1.36 | 0.002 |
| 9* | 23.5 | 1.34 | 0.003 | ○ | ○ | ○ | 5.0 | Δ | ○ | 20.8 | 1.38 | 0.003 |
| 10* | 23.3 | 1.36 | 0.006 | Δ | ○ | ○ | 4.5 | ○ | Δ | 17.6 | 1.39 | 0.005 |
| 11* | 25.6 | 1.33 | 0.006 | Δ | ○ | Δ | 4.5 | ○ | Δ | 18.2 | 1.39 | 0.005 |
| 12* | 21.8 | 1.37 | 0.002 | Δ | ○ | ○ | 4.5 | ○ | ○ | 21.4 | 1.37 | 0.001 |
| 13* | 24.5 | 1.31 | 0.007 | Δ | ○ | Δ | 4.5 | Δ | ○ | 21.8 | 1.33 | 0.005 |

| | High temperature/high humidity environment (30° C./80% RH) | | | | | |
|---|---|---|---|---|---|---|
| | Reproduction | | | | | |
| Carrier No. | Line image | Half tone image | Solid image | Resolution | Carrier adhesion | Toner Scattering |
| 1 | ○ | ○ | ○ | 5.6 | ○ | ○ |
| 2 | ○ | ○ | ○ | 5.6 | ○ | ○ |
| 3* | Δ | ○ | ○ | 4.5 | ○ | Δ |
| 4* | Δ | ○ | ○ | 4.5 | Δ | ○ |
| 5* | Δ | Δ | ○ | 4.0 | Δ | Δ |
| 6 | ○ | ○ | ○ | 5.6 | ○ | ○ |
| 7* | X | Δ | ○ | 4.0 | ○ | ○ |
| 8* | ○ | ○ | ○ | 5.6 | Δ | ○ |
| 9* | ○ | ○ | ○ | 5.0 | Δ | ○ |
| 10* | Δ | ○ | ○ | 4.5 | ○ | Δ |
| 11* | Δ | Δ | ○ | 4.0 | ○ | Δ |
| 12* | Δ | Δ | ○ | 4.0 | ○ | ○ |
| 13* | Δ | ○ | Δ | 4.5 | Δ | ○ |

*Comparison

The effectiveness of the present invention is evident from the data of Tables 1 to 3.

The carrier particles of the present invention have improved properties including electric charge quantity, electric resistance, and fluidity. Further benefits include a sharp distribution of electric charge, a quick rise of charging, and a reduced variation of electric charge with time. There are thus obtained images having minimized fog and carrier adhesion and improved image density, reproduction and resolution.

The resinous coating is fully tough. The carrier particles are highly durable during operation. A number of copying operations repeated under severe conditions invite only a small change with time of important factors including charge quantity, charging performance, image density, fog, reproduction, resolution, and carrier adhesion. In addition, the coating undergoes little wear or separation. Toner spent and toner scattering are reduced.

Although some preferred embodiments have been described, many modifications and variations may be made thereto in the light of the above teachings. It is therefore to be understood that within the scope of the appended claims, the invention may be practiced otherwise than as specifically described.

We claim:

1. In magnetic carrier particles for use in electrophotographic development, each in the form of a ferrite core particle having a resinous coating on the surface thereof, the improvement wherein at least 90% by weight of said ferrite core particles have a saturation magnetization of 45 to 55 emu/g and a particle size of 74 to 149 μm, said resinous coating has a copolymer composition comprising a major proportion of a copolymer of ethyl methacrylate and styrene having a styrene content of from 15 to 25% by weight of the copolymer, 0.1 to 2% by weight of dodecyl methacrylate, and 0.1 to 2% by weight of 2-hydroxyethyl acrylate, and the magnetic carrier particles have a resistance of $8.5\times10^7$ to $220\times10^7$ Ω.

2. The magnetic carrier of claim 1 wherein the coating further contains a resistance control agent.

3. The magnetic carrier of claim 2 wherein the resistance control agent is carbon black.

4. The magnetic carrier of claim 1 wherein the coating further contains a charge control agent.

5. The magnetic carrier of claim 1 wherein the coating continuously covers the underlying core particle and is 0.1 to 5 μm thick.

* * * * *